US005731273A

United States Patent [19]

Field

[11] Patent Number: 5,731,273

[45] Date of Patent: Mar. 24, 1998

[54] LUBRICATING COMPOSITIONS

[75] Inventor: Ian Peter Field, Oxfordshire, United Kingdom

[73] Assignee: Exxon Chemical Patents Inc., Wilmington, Del.

[21] Appl. No.: 737,685

[22] PCT Filed: May 15, 1995

[86] PCT No.: PCT/EP95/01824

§ 371 Date: Nov. 13, 1996

§ 102(e) Date: Nov. 13, 1996

[87] PCT Pub. No.: WO95/31522

PCT Pub. Date: Nov. 23, 1995

[30] Foreign Application Priority Data

May 16, 1994 [GB] United Kingdom ..... 9409756

[51] Int. Cl.[6] ..... C10M 141/00

[52] U.S. Cl. ..... 508/251; 508/253; 508/254; 508/364; 508/370

[58] Field of Search ..... 508/251, 253, 508/254, 364, 370

[56] References Cited

U.S. PATENT DOCUMENTS

| | | | |
|---|---|---|---|
| 2,781,318 | 2/1957 | Cypers | 508/251 |
| 3,803,140 | 4/1974 | Cook et al. | 508/251 |
| 4,552,677 | 11/1985 | Hopkins | 508/290 |
| 4,648,985 | 3/1987 | Thorsell et al. | 508/364 |
| 4,664,822 | 5/1987 | Hunt et al. | 252/32.7 E |
| 4,785,095 | 11/1988 | Salomon | 544/38 |
| 4,867,890 | 9/1989 | Colclough et al. | 508/364 |
| 5,024,774 | 6/1991 | Salomon | 252/47 |
| 5,034,019 | 7/1991 | Salomon | 44/334 |

FOREIGN PATENT DOCUMENTS

| | | | |
|---|---|---|---|
| 024146 | 2/1981 | European Pat. Off. . | |
| 0280579 | 8/1988 | European Pat. Off. | C10M 141/08 |
| 280580 | 8/1988 | European Pat. Off. . | |
| 0275935 | 12/1990 | European Pat. Off. | F16J 1/02 |
| 0425367 | 5/1991 | European Pat. Off. | C10M 159/20 |
| 444830 | 8/1991 | European Pat. Off. . | |
| 0475904 | 3/1992 | European Pat. Off. | C07D 279/00 |
| 92/18589 | 10/1992 | WIPO . | |

*Primary Examiner*—Ellen M. McAvoy
*Attorney, Agent, or Firm*—Ohlandt, Greeley, Ruggiero & Perle

[57] ABSTRACT

Crankcase lubricant compositions for use in automobile or truck engines comprise a major proportion of a lubricating oil, and an antioxidant system comprising added copper present in oil-soluble form and at least one oil-soluble phenothiazine.

28 Claims, No Drawings

LUBRICATING COMPOSITIONS

The present invention relates to lubricating compositions, including functional fluids. The invention relates in particular to crankcase lubricants for automobiles and trucks.

There is an increasing demand for longer intervals between changes in crankcase oils, and for a reduction in the volume of used oil to be disposed of. For these and other reasons, there is a need to improve the efficiency and useful life of oil-based lubricants, particularly those used as crankcase lubricants in internal combustion engines in automobiles and trucks.

One of the factors which substantially shortens the useful life of lubricating compositions is oxidation of the oil component. Oxidation results in the formation of acids, which tend to corrode engine parts, and in an undesirable increase in viscosity, which renders the composition less useful as a lubricant.

While high quality oils are themselves relatively resistant to oxidation, contaminants, for example iron, which are inevitably present in internal combustion engines, and common lubricant additives, for example magnesium- and/or calcium-containing detergents and alkenyl succinic acid/polyamine or polyester dispersants, have the effect of greatly accelerating the oxidation process, to the extent that oxidation is one of the major contributors to reduced lubricant life. Further, lower quality basestocks have a greater tendency to oxidize than do basestocks of higher quality.

Examples of oxidation inhibitors which have been proposed for use in crankcase lubricants are zinc dihydrocarbyl dithiophosphates which, although primarily used as antiwear agents, also act as antioxidants; aromatic amines, for example, alkylated diphenylamines and phenyl-α-naphthylamines; hindered phenols; alkaline earth metal salts of sulphurized alkyl phenols in which the alkyl groups preferably contain 5 to 12 carbon atoms, for example, calcium nonylphenyl sulphide and barium octylphenyl sulphide; phosphosulphurized or sulphurized hydrocarbons; and oil-soluble copper compounds.

Some of the above-mentioned oxidation inhibitors have been found to be very effective in use. European Patent Specification No. 24 146 B claims lubricating compositions comprising a major amount of lubricating oil, from 1 to 10 wt % of certain ashless dispersant compounds or from 0.3 to 10 wt % of certain ashless dispersant compounds or from 0.3 to 10 wt % of certain nitrogen- or ester-containing polymeric viscosity index improver dispersants, or mixtures of dispersant(s) and viscosity index improver dispersant(s), 0.01 to 5 wt % of zinc dihydrocarbyl dithiophosphate (ZDDP) and 5 to 500 parts per million by weight of added copper in the form of an oil-soluble copper compound. For particularly severe conditions, where it may be desirable to use a supplementary antioxidant, the amount of the supplementary antioxidant required is small (far less than the amount required in the absence of the copper compound). Supplementary antioxidants mentioned in Specification No. 24 146 B include diphenylamine, alkylated diphenylamines, and phenyl-1-naphthylamine and its alkylated derivatives.

Despite the effectiveness of the copper-containing compositions discussed above, even more highly effective antioxidants for lubricating compositions, particularly lubricating compositions suitable for use as crankcase lubricants, would represent an important contribution to the art.

It has now been found that copper and a phenothiazine, optionally together with an aromatic amine, provide surprisingly good oxidation control as the sole antioxidant system, or in combination with other antioxidants.

The present invention provides the use of copper present in oil-soluble form and at least one oil-soluble phenothiazine as an antioxidant system for a lubricating composition, that is, to inhibit oxidation of the lubricating composition.

The invention also provides a lubricating composition suitable for use as a crankcase lubricant, comprising a major proportion of lubricating oil, 1 to 500 parts per million by mass (ppm) of added copper present in oil-soluble form, and from 0.01 to 2 mass %, preferably 0.05 to 1 mass %, of at least one oil-soluble phenothiazine.

The invention further provides a lubricating composition comprising a major proportion of lubricating oil, 1 to 100 ppm of added copper present in oil-soluble form, and from 0.01 to 2 mass %, preferably 0.05 to 1 mass %, of at least one oil-soluble phenothiazine.

The applicants have surprisingly found that the use of a two-component antioxidant system in accordance with the invention makes it possible to obtain high levels of antioxidant activity using only very low levels of metal in the system (although the use of higher levels of metal is not excluded). Thus, for example, the invention may be of advantage in applications where only low levels of copper are permitted. They have also found that systems containing three or more components (where the copper/phenothiazine system is used together with an additional antioxidant) may give excellent oxidation control.

U.S. Pat. No. 4,785,095 discloses certain phenothiazines which are N-substituted and which contain an additional sulphur atom in the N substituent. The phenothiazines are said to be useful as oxidation inhibitors for lubricating oils or fuels. The U.S. patent also contains summaries of a number of earlier U.S. patents which describe phenothiazines of various types. These patents include U.S. Pat. No. 3,803,140, in which copper bis (trifluoroacetylacetonates) and copper phthalocyanines are mentioned as metal complexants for use in compositions which also contain certain substituted phenothiazines. Various phenothiazines are also described in U.S. Pat. Nos. 5,024,774 and 5,034,019. None of the above patents suggests that oil-soluble copper be used as an additional antioxidant in a composition which also contains a phenothiazine antioxidant.

European Specification No. 475 904A discloses a mixture of phenothiazines obtainable by reacting a specified mixture of diphenylamines with elemental sulphur in the presence of a condensation catalyst selected from iodine, aluminium bromide or chloride, ferric chloride, antimony chloride, copper iodide or sulphur iodine, iodine being the preferred catalyst. The mixture of phenothiazines will normally also contain unreacted diphenylamines, the phenothiazines preferably comprising 10 to 20 wt % and the diphenylamines 80 to 90 wt % of the total mixture. The mixture is said to be useful as an antioxidant for a wide variety of organic materials, including lubricants.

As will be shown below, the applicants have surprisingly found that in the antioxidant systems of the invention there is a synergistic effect such that the systems have a degree of antioxidant activity significantly in excess of the activity that might be predicted on the basis of the antioxidant activity of the individual components of the system.

As indicated earlier, the compositions of the invention contain added copper. The term "added copper" excludes copper present in the oil as a result of accumulation of copper in the oil during use, for example, as the result of wear or corrosion of copper-containing parts.

The proportion of added copper in the compositions of the invention is advantageously at least 1 ppm, preferably at least 3 ppm. The proportion of added copper advantageously does not exceed 500 ppm, and preferably does not exceed 250 ppm. Especially advantageous compositions have proportions of copper in the range of from 3 to 100 ppm.

The copper is stated above to be present in the compositions in oil-soluble form. Where a substance is stated in this specification to be oil-soluble, this does not mean that the substance must be soluble in oil in all proportions. It does, however, mean that, in the final lubricating composition, for example, the composition in the form in which it is introduced into the crankcase of an engine, which composition may, and normally will, contain other additives, one or more of which may promote the solubility of the substance in question, the substance is soluble to an extent sufficient to have its intended effect in the environment in which the lubricating composition is employed. Further, the term oil-soluble as used herein also includes the case where a substance is colloidally dispersible in oil provided that in the final lubricating composition the substance can have its intended effect in the environment in which the lubricating composition is employed.

The copper is advantageously incorporated in the composition in the form of an oil-soluble copper compound. The copper compound may be in cuprous or cupric form. Examples of suitable oil-soluble copper compounds include the oil-soluble copper compounds mentioned in European Patent Specification Nos. 24 146 B, 280 579 A and 280 580 A, the disclosures of all of which are incorporated herein by reference. Thus, for example, the copper may be blended into the oil as an oil-soluble copper salt of a synthetic or natural carboxylic acid. Examples of carboxylic acids from which suitable copper salts may be derived include $C_2$ to $C_{18}$ fatty acids, for example, acetic acid, stearic acid and palmitic acid; unsaturated acids, for example, oleic acid; branched carboxylic acids, for example, naphthenic acids of molecular weight of from 200 to 500, neodecanoic acid and 2-ethylhexanoic acid; and alkyl- or alkenyl-substituted dicarboxylic acids, for example, alkenyl-substituted succinic acids, for example, octadecenyl succinic acids, dodecenyl succinic acids and polyisobutenyl succinic acids. In some cases, suitable compounds may be derived from an acid anhydride, for example, from a substituted succinic anhydride.

Examples of copper compounds derived from polyalkenyl-substituted succinic acids or anhydrides are copper salts derived from polyisobutenyl succinic anhydride, and copper salts of polyisobutenyl succinic acid. Preferably, the copper is in its divalent cupric form, $Cu^{II}$. The preferred acids are polyalkenyl succinic acids in which the alkenyl group has a molecular weight greater than about 700. The alkenyl group desirably has a $\overline{M}_n$, which may conveniently be measured by an appropriately calibrated gel permeation chromatograph (GPC), from about 900 to 1,400, with a $\overline{M}_n$ of about 950 being more preferred.

The copper may be blended into the oil as a copper dithiocarbamate of the general formula $(R^1R^2NCSS)_nCu$ or a copper dithiophosphate of the general formula $[R^1O(R^2O)P(S)S]_nCu$, where n is 1 or 2 and each of $R^1$ and $R^2$, which may be the same or different, represents a hydrocarbyl radical containing 1 to 18, preferably 2 to 12 carbon atoms, for example, an alkyl, alkenyl, aryl, aralkyl, alkaryl or cycloalkyl radical. Other copper- and sulphur-containing compounds, for example, copper mercaptides, xanthates, and thioxanthates, are also suitable for use in accordance with the invention, as are copper sulphonates, (optionally sulphurized) phenates and acetylacetonates.

Other copper compounds which may be used in accordance with the invention are overbased copper compounds. Examples of such compounds, and of processes for their preparation, are given, for example, in U.S. Pat. No. 4,664,822 and European Specification No. 0 425 367 A, the disclosures of both of which are incorporated herein by reference. In the preparative processes described in the U.S. specification, the copper is used in an essentially oil-insoluble form, for example as the chloride, sulphate or $C_1$ to $C_6$ carboxylate, but in the overbased product the copper is incorporated into the colloidally dispersed material in such a way that the product can act as an antioxidant for a lubricating composition. The European specification describes the use of copper $C_7$ to $C_{10}$ carboxylates which are partially soluble in hydrocarbons so that in the overbased product they are situated at the interface of the base oil and colloidally dispersed micelles. The copper-containing overbased products have an antioxidant effect when used in lubricating oils.

The copper may be introduced into the oil in an oil-insoluble form provided that in the finished lubricating composition the copper is in oil-soluble form.

As indicated earlier, the compositions of the invention contain at least one oil-soluble phenothiazine. The proportion of phenothiazine(s) is advantageously from 0.01 to 2 mass %, preferably 0.05 to 1 mass %.

The phenothiazine is advantageously an oil-soluble compound of the formula I

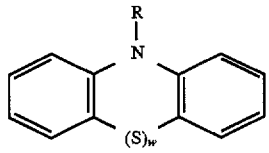

(I)

wherein each of the aromatic rings may be unsubstituted, or substituted by one or more substituents, w is an integer from 1 to 4, preferably 1, and R represents a hydrogen atom or a hydrocarbyl radical, which hydrocarbyl radical may if desired contain one or more hetero atoms. The phenothiazines used in accordance with the invention also include the oxidation products of such compounds in which the ring sulphur atom, and/or any other sulphur atom that may be present in the molecule, is oxidized to give a sulphone or sulphoxide group.

Examples of suitable substituents for the aromatic rings in the above formula I include hydrocarbyl radicals, radicals of the formula $ZR^3$ (wherein Z represents O or S and $R^3$ represents a hydrocarbyl radical), hydroxyl radicals, halogen atoms, and fused aromatic rings, which fused aromatic rings may themselves be substituted by one or more substituents selected from hydrocarbyl radicals, $ZR^3$ radicals and halogen atoms. Suitable hydrocarbyl radicals are, for example, those having up to about 30 carbon atoms, preferably up to about 20 carbon atoms.

Hydrocarbyl radicals referred to in the preceding paragraph, and specific examples of hydrocarbyl radicals mentioned below, may contain one or more hetero atoms. Such hetero atoms may, for example, interrupt a hydrocarbon chain or ring and/or form, or form part of, a substituent on a hydrocarbon group. Examples of hetero atoms or hetero groups which may be contained in substituents for the aromatic rings are amine, amide, cyano, sulphide, carboxyl, and hydroxy groups, and oxygen and sulphur atoms. The hetero atom(s) may cause the substituents to have characteristics which are not typical of hydrocarbyl groups containing carbon and hydrogen only.

The two aromatic phenothiazine rings may carry different substituents, and/or substituents in different positions.

Where there are two or more substituents on the same ring, these may differ from one another. In some cases it may be advantageous for one or both of the rings to carry a substituent in the position para to the carbon atom to which the phenothiazine nitrogen atom is attached: the para-substituted compounds are in general easier to manufacture. Phenothiazines in which the aromatic rings are symmetrically substituted with regard to the nature and position of the substituents may be preferable as being relatively easy to prepare, but the use of such compounds is not essential. Thus, for example, one phenothiazine aromatic ring may be unsubstituted or carry, e.g., an alkyl substituent, while the other is substituted by a fused aromatic ring (giving a naphthalene radical).

Examples of specific substituents for the aromatic rings are alkyl, alkenyl, aryl, alkaryl, aralkyl, hydroxyl, alkoxy, alkylthio and arylthio radicals, halogen atoms, and fused aromatic rings.

Preferred hydrocarbyl radicals as substituents for the phenothiazine aromatic rings or as $R^3$ are alkyl radicals, especially alkyl radicals having up to 20 carbon atoms, for example up to 16 carbon atoms, especially up to 12 carbon atoms. The alkyl radicals preferably have at least 4 carbon atoms. The alkyl radicals may be straight chain or branched, although in some cases branched radicals may be preferred. In some cases it may be advantageous if a tertiary carbon atom is directly attached to the aryl radical (for example the benzene or naphthalene radical) of which it is a substituent.

Examples of specific alkyl radicals are n-butyl, tert.-butyl, i-pentyl, tert-pentyl, n-hexyl, tert.-octyl, n-decyl, n-dodecyl, and tert.-dodecyl radicals.

Further examples of suitable substituents for the phenothiazine aromatic rings are given in U.S. Pat. No. 4,785,095 and the patents discussed therein. The disclosures of all those patents are incorporated herein by reference.

If the phenothiazine ring nitrogen atom is unsubstituted, the total number of carbon atoms in all the substituent(s), taken together, on the ring carbon atoms is such that the phenothiazine is oil-soluble.

As indicated above, the phenothiazine ring nitrogen atom may be substituted by a hydrocarbyl radical, which hydrocarbyl radical may contain one or more hetero atoms. Such hetero atoms may, for example, interrupt a hydrocarbon chain or ring or form, or form part of, a substituent on a hydrocarbon group. Examples of hetero atoms or hetero groups which a hydrocarbyl radical represented by R may contain are amine, amide, cyano, sulphide, carboxyl, and hydroxyl groups, and oxygen and sulphur atoms. The hetero atom(s) may cause the substituents to have characteristics which are not typical of hydrocarbyl groups containing carbon and hydrogen only.

Examples of radicals which may be present as substituents on the phenothiazine ring nitrogen atom are hydrocarbyl radicals having 1 to 20, advantageously 1 to 12, preferably 1 to 6, carbon atoms, and cyanoalkyl and hydroxyalkyl radicals in which the alkyl moieties have 1 to 20, preferably 2 to 8, carbon atoms.

Examples of suitable hydrocarbyl radicals are alkyl radicals having 1 to 12, preferably 1 to 4, carbon atoms, alkenyl radicals having 2 to 12 carbon atoms, cycloalkyl radicals having 5 to 20, especially 5 to 12, carbon atoms, and aralkyl radicals having 7 to 9 carbon atoms. Specific examples of such radicals are methyl, n-butyl, i-pentyl, n-hexyl, n-octyl, tert.-octyl, n-dodecyl, phenyl, tolyl, cyanoethyl, cyanopropyl, cyanobutyl, and benzyl radicals.

Examples of substituents which are hydrocarbyl radicals interrupted by hetero atoms are radicals of the formula —$CH_2$—O—Y, wherein Y represents a hydrocarbyl radical which may contain one or more hetero atoms. Thus, for example, Y may represent an alkyl, aryl, alkaryl, aralkyl, cycloalkyl, alkoxyalkyl, cycloalkoxyalkyl or aryloxyalkyl radical, preferably an alkyl radical having 1 to 20, preferably 1 to 12, especially 1 to 4, carbon atoms or a cycloalkyl radical having 5 to 20, especially 5 to 12, carbon atoms. A specific example of a substituent of the formula —$CH_2$—O—Y is the methoxymethyl radical.

Especially preferred phenothiazines for use in accordance with the present invention are those, for example those of formula I above, having a sulphur-containing substituent on the phenothiazine ring nitrogen atom.

Examples of sulphur-containing substituents for the phenothiazine ring nitrogen atom are groups of the formula —$A_1$—S—$A_2$, wherein $A_1$ represents a hydrocarbylene radical and $A_2$ represents an alkyl, cycloalkyl, alkenyl, aryl, alkaryl or aralkyl radical, each of the radicals represented by $A_1$ and $A_2$ optionally containing one or more hetero atoms. $A_1$ preferably represents an alkylene or alkenylene radical having 1 to 18 carbon atoms, especially a linear alkylene radical having up to 8 carbon atoms, for example, one carbon atom. $A_2$ preferably represents an alkyl radical or a group of the formula $$-[Y^1(CO_2)]_x(Y^2)_yY^3$$

wherein x and y are independently zero or 1, $Y^1$ represents an alkylene radical, preferably a methylene radical, $Y^2$ represents an alkylene radical containing 1 to 8 carbon atoms, and $Y^3$ represents an alkyl, cycloalkyl, alkenyl, alkaryl, aralkyl or aryl radical, for example, an alkyl radical containing 1 to 18 carbon atoms; a cycloalkyl radical containing 5 to 7 ring carbon atoms and optionally substituted by one or more alkyl radicals having 1 to 18 carbon atoms; a phenyl radical optionally substituted by one or more radicals selected from alkyl, alkoxy and alkylthio radicals such that the total number of carbon atoms in the substituted phenyl radical is 7 to 30; or a naphthyl radical optionally substituted by one or more radicals selected from alkyl, alkoxy and alkylthio radicals such that the total number of carbon atoms in the substituted naphthyl radical is 11 to 40.

Preferred sulphur-containing substituents for the phenothiazine ring nitrogen atom are groups of the formula —$A_3$—S—$(CH_2CO_2)_xA_4$, wherein $A_3$ represents an alkylene, alkenylene or aralkylene radical, $A_4$ represents an alkyl, cycloalkyl, alkenyl, aryl, alkaryl, or aralkyl radical, and x is zero or 1. Advantageously, $A_3$ represents an alkylene radical, especially a methylene radical, $A_4$ represents an alkyl radical, and x is zero or 1. Especially preferred compounds are those in which $A_3$ represents a methylene radical, and either x is zero and $A_4$ represents an alkyl radical preferably having 6 to 15, for example, 9 to 12 carbon atoms, for example, a tert.-nonyl, n-dodecyl or tert.-dodecyl group, or x is 1 and $A_4$ represents an alkyl radical having 6 to 10 carbon atoms, for example, a 2-ethylhexyl radical or an i-octyl radical.

If the phenothiazine aromatic rings are unsubstituted, or do not carry substituent(s) containing sufficient carbon atoms to render the phenothiazines oil-soluble, the phenothiazine ring nitrogen atom should be substituted in such as way that the phenothiazine is oil-soluble.

Examples of phenothiazines which may be used in accordance with the invention, and methods for making phenothiazines, are given in U.S. Pat. Nos. 4,785,095 and 5,024,774 and European specification No. 275 935 B and the specifications referred to in those documents.

The compositions of the invention advantageously contain one or more oil-soluble aromatic amines. Thus, the compositions advantageously contain a total of from 0.05 to 2 mass %, preferably 0.1 to 1 mass %, and especially 0.1 to 0.5 mass %, of one or more oil-soluble aromatic amines. A mixture of amines may be used if desired. In determining the proportion of amine, the mass of any diluent oil added with the amine should be ignored; that is, the proportions of amine given herein are "active ingredient" proportions.

Aromatic amines for use in accordance with the invention have at least one aromatic group directly attached to at least one amine nitrogen atom. Secondary aromatic amines, especially (see below) those having two aromatic groups attached to the same amine nitrogen atom, are preferred for use in accordance with the invention, but the use of other aromatic amines is not excluded. The aromatic amines used in accordance with the invention are preferably those having antioxidant properties in crankcase oils even in the absence of the copper compounds and phenothiazines used in accordance with the invention.

Aromatic groups in amines for use in accordance with the invention advantageously contain from 6 to 16 carbon atoms. The amines may contain one or more aromatic groups, for example at least two aromatic groups. Where there are two aromatic groups both are preferably bonded directly to the same amine nitrogen atom. Compounds in which two aromatic groups are linked by a covalent bond or by an atom or group for example, an oxygen or sulphur atom, or a —CO—, —$SO_2$— or alkylene group may also be used. Aromatic rings, which are preferably aromatic hydrocarbon rings, may be unsubstituted or substituted by one or more substituents selected from, for example, alkyl, cycloalkyl, alkoxy, aryloxy, acyl, acylamino, hydroxy and nitro groups. Amines containing alkylsubstituted aromatic hydrocarbon rings are preferred, especially those containing two alkyl-substituted phenyl groups.

Other atoms or groups which may be bonded to the or each amine nitrogen atom in aromatic amines suitable for use in accordance with the invention include, for example, hydrogen atoms and alkyl and aralkyl groups; such alkyl and aralkyl groups may optionally be substituted, for example, by one or more groups selected from hydroxyl, alkyl and alkoxy groups.

Examples of aromatic amines which may be used in accordance with the invention are amines of the formula

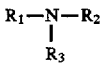

wherein $R_1$ and $R_2$, which represent the same or different radicals, each represents a hydrogen atom, an alkyl group having 1 to 18 carbon atoms, an aryl group having 6 to 16 carbon atoms, an alkaryl group having from 7 to 34 carbon atoms or an aralkyl group having from 7 to 12 carbon atoms, and $R_3$ represents an aryl group having from 6 to 16 carbon atoms or an alkaryl group having from 7 to 34 carbon atoms. Each of the alkyl, aryl, alkaryl and aralkyl groups mentioned in the definitions of $R_1$, $R_2$, and $R_3$ may if desired be substituted by one or more substituents selected, for example, from alkyl, cycloalkyl, alkoxy, aryloxy, acyl, acylamino, hydroxy and nitro groups.

Preferred N-aryl amines for use in accordance with the invention are naphthylamines, phenylnaphthylamines, and, more especially, diphenylamines, including substituted diphenylamines, particularly diphenylamines of the formula:

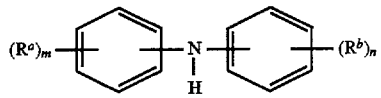

wherein $R^a$ and $R^b$, which represent the same or different radicals, each represents an alkyl group having 1 to 28 carbon atoms, and m and n represent 0, 1 or 2.

Aromatic diamines may also be used in accordance with the invention. Suitable aromatic diamines include those of the formula:

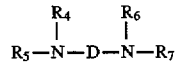

in which $R_4$, $R_5$, $R_6$ and $R_7$ represent the same or different radicals and each represents a hydrogen atom, an alkyl group having from 1 to 12 carbon atoms or an aryl, alkaryl or aralkyl group each having from 6 to 22 carbon atoms, and D represents an arylene group containing 6 to 14 carbon atoms or a group of the formula:

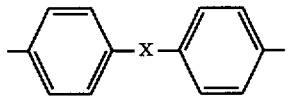

wherein X represents a covalent bond (so that the rings are joined directly to each other via a single bond), an alkylene group containing 1 to 8 carbon atoms, a —CO— or —$SO_2$— group or —O— or —S—. D may be unsubstituted or may contain one or more substituents selected from, for example, alkyl and alkoxyl groups.

As indicated in more detail below, additional additives may be incorporated in the compositions of the invention to enable them to meet particular requirements. Thus, for example, the compositions advantageously also comprise:

(A) a total of from 1 to 10 mass % of one or more ashless dispersant compounds; or (B) a total of 0.3 to 10 mass % of one or more nitrogen- or ester-containing viscosity index improver dispersants; or (C) a mixture of an ashless dispersant compound and a said viscosity index improver dispersant.

The compositions advantageously also comprises a total of from 2 to 8000 ppm of calcium and/or magnesium, and preferably comprises from 500 to 5000 ppm of calcium and/or magnesium as a basic calcium sulphonate and/or a basic magnesium sulphonate. The compositions may comprise, for example, 0.01 to 5 mass % of one or more other lubricant antioxidants, particularly one or more ZDDPs and/or sulphurized alkyl phenols or phenates.

The components of the antioxidant system used in accordance with the invention may be incorporated into a base oil in any convenient way. Thus, each of the components can be added directly to the oil by dispersing or dissolving it in the oil at the desired level of concentration. Such blending may occur at ambient temperature or at an elevated temperature.

The components of the antioxidant system may be incorporated individually into the base oil, or any two, or all, of the components may be incorporated together. Where all the components are added together they are conveniently added in the form of a concentrate comprising a solution, typically in oil, containing (1) from 10 ppm to 30 mass %, advantageously 10 ppm to 5 mass %, of copper present in oil-soluble form; and (2) from 0.1 to 30 mass %, preferably 0.1 to 20 mass %, especially 0.5 to 10 mass %, of one or more oil-soluble phenothiazines.

Such a concentrate advantageously also comprises (A) from 0 to 60 mass % of an ashless dispersant and/or from 0 to 40 mass % of a polymeric viscosity index improver dispersant (although such a viscosity index improver dispersant would normally be added separately), and/or (B) a total of from 0.0 to 8 mass % of calcium and/or magnesium. The concentrate may also contain a total of from 0 to 60 mass % of one or more zinc dihydrocarbyl dithiophosphates. As indicated later in this specification, other additives may also be present in concentrates.

A concentrate as discussed above could be in a number of parts which are added separately to the base oil. Thus, for example, the copper and phenothiazine(s) could be present in one part, and the aromatic amine, if used, and the other additives in another part.

All proportions given in this specification are based on the total mass of the final composition or concentrate, including the mass of any additional constituents not specifically referred to.

Base oils suitable for use in the compositions of the invention include those suitable for use as crankcase lubricating oils for spark-ignited and compression-ignited internal combustion engines, for example, automobile and truck engines, marine and railroad diesel engines, and those suitable for use as aviation lubricants or as lubricants for two cycle engines. The base oils may be natural or synthetic.

The lubricating oil base stock conveniently has a viscosity of about 2.5 to about 12 cSt or $mm^2/s$ and preferably about 2.5 to about 9 cSt. or $mm^2/s$ at 100° C. Mixtures of synthetic and natural base oils may be used if desired.

As indicated above, additional additives may be incorporated in the compositions of the invention to enable them to meet particular requirements. Examples of additives which may be included in lubricating oil compositions are detergents and metal rust inhibitors, viscosity index improvers, corrosion inhibitors, other oxidation inhibitors, friction modifiers, diapersants, anti-foaming agents, anti-wear agents, pour point depressants, and rust inhibitors. Some of these classes of additives have already been mentioned earlier in this specification but, where appropriate, additional information is given below.

Detergents and metal rust inhibitors include, for example, the oil-soluble sulphonates, phenates, sulphurized phenates, thiophosphonates, salicylates, and naphthenates and other oil-soluble carboxylates of a metal, particularly the alkali or alkaline earth metals or magnesium, for example, sodium, lithium, calcium, barium and magnesium. The most commonly used metals are calcium and magnesium, mixtures of calcium and magnesium, and mixtures of calcium and/or magnesium with sodium. The detergents may be overbased: overbased detergents function both as detergents and acid neutralizers, thereby reducing wear and corrosion and extending engine life.

Representative examples of suitable viscosity modifiers are polyisobutylene, copolymers of ethylene and propylene, polymethacrylates, methacrylate copolymers, copolymers of an unsaturated dicarboxylic acid and a vinyl compound, interpolymers of styrene and acrylic esters, and partially hydrogenated copolymers of styrene/isoprene, styrene/butadiene, and isoprene/butadiene, as well as the partially hydrogenated homopolymers of butadiene and isoprene.

In accordance with the invention, the use of a supplementary antioxidant is not normally necessary. A supplementary antioxidant may however be used if desired or required in a particular case. Examples of supplementary antioxidants include antioxidants mentioned earlier in this specification. Suitable supplementary antioxidants include, for example, other aromatic amines, for example alkylated phenylamines and phenyl α-napthylamine; hindered phenols; alkaline earth metal salts of sulphurized alkyl-phenols having preferably $C_5$ to $C_{12}$ alkyl side chains, e.g., calcium nonylphenyl sulphide; barium octylphenyl sulphide; hindered phenols; phosphosulphurized or sulphurized hydrocarbons; and other oil-soluble copper compounds, for example those mentioned earlier in this specification.

Friction modifiers and fuel economy agents which are compatible with the other ingredients of the final oil may also be included. Examples of such materials are glyceryl monoesters of higher fatty acids, for example, glyceryl mono-oleate; esters of long chain polycarboxylic acids with diols, for example, the butane diol ester of a dimerized unsaturated fatty acid; oxazoline compounds; and alkoxylated alkyl-substituted mono-amines, diamines and alkyl ether amines, for example, ethoxylated tallow amine, ethoxylated tallow ether amine, and the like.

In general, suitable dispersants include oil soluble salts, amides, imides, oxazolines and esters, or mixtures thereof, of long chain hydrocarbon-substituted mono and dicarboxylic acids or their anhydrides; long chain aliphatic hydrocarbons having a polyamine attached directly thereto; and Mannich condensation products formed by condensing about 1 molar proportion of a long chain substituted phenol with about 1 to 2.5 moles of formaldehyde and about 0.5 to 2 moles of a polyalkylene polyamine. In these dispersants long chain hydrocarbon groups are suitably derived from polymers of a $C_2$ to $C_5$ monoolefin, the polymers typically having a number average molecular weight of from 700 to 5000.

A viscosity index improver dispersant functions both as a viscosity index improver and as a dispersant. Examples of viscosity index improver dispersants suitable for use in accordance with the invention include reaction products of amines, for example polyamines, with a hydrocarbyl-substituted mono -or dicarboxylic acid in which the hydrocarbyl substituent comprises a chain of sufficient length to impart viscosity index improving properties to the compounds. In general, the viscosity index improver dispersant may be, for example, a polymer of a $C_4$ to $C_{24}$ unsaturated ester of vinyl alcohol or a $C_3$ to $C_{10}$ unsaturated monocarboxylic acid or a $C_4$ to $C_{10}$ di-carboxylic acid with an unsaturated nitrogen-containing monomer having 4 to 20 carbon atoms; a polymer of a $C_2$ to $C_{20}$ olefin with an unsaturated $C_3$ to $C_{10}$ mono- or di-carboxylic acid neutralised with an amine, hydroxyamine or an alcohol; or a polymer of ethylene with a $C_3$ to $C_{20}$ olefin furlher reacted either by grafting a $C_4$ to $C_{20}$ unsaturated nitrogen—containing monomer thereon or by grafting an unsaturated acid onto the polymer backbone and then reacting carboxylic acid groups of the grafted acid with an amine, hydroxy amine or alcohol.

Examples of dispersants and viscosity index improver dispersants which may be used in accordance with the invention may be found in European Patent Specification No. 24146 B referred to above.

Antiwear agents include zinc dihydrocarbyl dithiophosphates (ZDDPs). Especially preferred ZDDPs for use in oil-based compositions are those of the formula $Zn[SP(S)(OR_a)OR_b]_2$ wherein $R_a$ and $R_b$ may be the same or different hydrocarbyl radicals containing from 1 to 18, and preferably 2 to 12, carbon atoms, for example, alkyl, alkenyl, aryl, aralkyl, alkaryl and cycloaliphatic radicals. Particularly preferred as $R_a$ and $R_b$ radicals are alkyl radicals having 2 to 8 carbon atoms. Examples of radicals which $R_a$ and $R_b$ may represent are ethyl, n-propyl, i-propyl, n-butyl, i-butyl, sec-butyl, amyl, n-hexyl, i-hexyl, i-heptyl, i-octyl, i-decyl, dodecyl, octadecyl, 2-ethylhexyl, nonylphenyl, dodecylphenyl, cyclohexyl and methylcyclopentyl radicals. In order to obtain oil solubility, the total number of carbon atoms in $R_a$ and $R_b$ will generally be about 5 or greater.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, and polymethacrylates. Foam control can be provided by an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and need not be further elaborated herein.

When lubricating compositions contain one or more of the above-mentioned additives, each additive is typically blended into the base oil in an amount which enables the additive to provide its desired function. Representative effective amounts of such additives, when used in crankcase lubricants, are as follows:

| Additive | Mass % a.i.* (Broad) | Mass % a.i.* (Preferred) |
|---|---|---|
| Detergents/Rust Inhibitors | 0.01–6 | 0.01–4 |
| Viscosity Modifier | 0.01–6 | 0.01–4 |
| Corrosion Inhibitor | 0.01–5 | 0.01–1.5 |
| Oxidation Inhibitor | 0.01–5 | 0.01–1.5 |
| Dispersant | 0.1–20 | 0.1–8 |
| Pour Point Depressant | 0.01–5 | 0.01–1.5 |
| Anti-Foaming Agent | 0.001–3 | 0.001–0.15 |
| Anti-wear Agents | 0.01–6 | 0.01–4 |
| Friction Modifier | 0.01–5 | 0.01–1.5 |
| Mineral or Synthetic Base Oil | Balance | Balance |

*Mass % active ingredient based on the final oil.

As indicated earlier, when a plurality of additives are employed it may be desirable, although not essential, to prepare one or more additive concentrates comprising the additives (concentrates sometimes being referred to herein as additive packages) whereby several additives can be added simultaneously to the base oil to form the lubricating oil composition. Dissolution of the additive concentrate(s) into the lubricating oil may be facilitated, for example, by mixing with heating, but this is not essential. The concentrate(s) or additive package(s) will typically be formulated to contain the additive(s) in proper amounts to provide the desired concentration in the final formulation when the additive package(s) is or are combined with a predetermined amount of base lubricant. Thus, the components of the antioxidant system used in accordance with the present invention can be added to small amounts of base oil or other compatible solvents along with other desirable additives to form one or more additive packages containing active ingredients in an amount, based on the additive package, of, for example, from about 2.5 to about 90 mass %, and preferably from about 5 to about 75 mass %, and most preferably from about 8 to about 50 mass % by weight, additives in the appropriate proportions with the remainder being base oil.

The final formulations may employ typically about 10 mass % of the additive package(s) with the remainder being base oil.

The following Examples illustrate the invention. In the Examples, all proportions of constituents are active ingredient proportions by mass, calculated on the mass of the total composition, unless otherwise specified.

COMPARATIVE EXAMPLES 1 TO 3 AND EXAMPLE 1

Various additives were evaluated in a lubricating base formulation. The susceptibility of the formulations to oxidation was measured using a bench test, the ERCOT test, designed to simulate the oxidative, iron-catalysed reactive environment of an internal combustion engine. In the ERCOT test, a sample of the composition under test containing ferric acetylacetonate giving 40 ppm iron as catalyst is oxidized by passing air through the composition at elevated temperature, and the viscosity is determined at intervals using a Haake viscometer. A plot of the results obtained is used to estimate the time elapsing before a 200% increase in viscosity took place.

The effectiveness of a ZDDP (Comparative Example 1), a ZDDP and a di(alkylphenyl)amine (Comparative Example 2), an oil-soluble copper compound (Comparative Example 3), and a phenothiazine and an oil-soluble copper compound (Example 1), in inhibiting oxidation was determined by adding to the base formulation a ZDDP (available commercially as PARANOX 15 from Exxon Chemical Limited), di(nonyl-substituted phenyl)amine (available commercially, for example, as Naugalube 438L from Uniroyal Chemical Company), cupric oleate and/or the di(alkylphenyl)amine/phenothiazine mixture sold under the trade name Pearsall($^R$) 5212-29 by Witco (Argus-Pearsall Products Group, to give the proportions of ZDDP, amine, copper and mixture given in Table 1, and subjecting the resulting compositions to the ERCOT test using the conditions indicated above. Pearsall ($^R$) 5212-29 is a mixture of nonyl-substituted diphenylamine and phenothiazines as 50% active ingredients in oil and contains less than 2% of diphenylamine (DPA).

The results obtained in the ERCOT test are given in Table 1.

TABLE 1

| | Comp. Ex. 1 | Comp. Ex. 2 | Comp. Ex. 3 | Example 1 |
|---|---|---|---|---|
| ZDDP* | 1.0 | 1.0 | — | — |
| Cu Oleate | — | — | 0.63 | 0.63 |
| Naugalube 438L* | — | 1.0 | — | — |
| Pearsall 5212-29+ | — | — | — | 1.43 |
| Cu (ppm) | — | — | 250 | 250 |
| Added S (%) | 0.2 | 0.2 | — | 0.23 |
| ERCOT Viscosity after hours | | | | |
| 0 | 63 | 63 | 79 | 79 |
| 16 | 141 | 102 | 85 | 78 |
| 24 | — | 162 | 140 | 78 |
| 40 | — | — | — | 96 |
| 48 | — | — | — | 143 |

*Mass % active ingredient based on the total composition.
+Mass % commercial product based on the total composition.

The results given in Table 1 show that a significant improvement in antioxidant properties was obtained using the compositions according to the present invention.

COMPARATIVE EXAMPLES 4 TO 12 AND EXAMPLES 2 TO 12

A lubricating base formulation (Comparative Example 4) containing a dispersant, a metal detergent, and ZDDP was prepared, and the time elapsing before a 200% increase in the viscosity of the base formulation took place in the ERCOT test was measured.

The effectiveness of an oil-soluble copper compound, certain oil-soluble phenothiazines, and combinations thereof, in inhibiting oxidation was determined by adding to the base formulation 0.5 mass % of the phenothiazine, based on the composition with the phenothiazine, and cupric oleate to give the proportions of copper shown in Table 2 below. The phenothiazines used had the formula

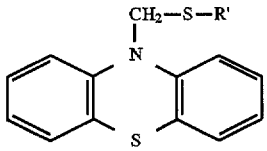

wherein R' represents (a) $—CH_2—C(O)OCH_2CH(C_2H_5)—(CH_2)_3—CH_3$ (b) $—CH_2—C(O)OiC_8H_{17}$ (c) $—nC_{12}H_{25}$ (d) $—tC_{12}H_{25}$ (e) $—tC_9H_{19}$ The resulting compositions (Comparative Examples 5 to 12 and Examples 2 to 12) were subjected to the ERCOT test using the same conditions as for the base formulation (Comparative Example 4). The results are shown in Table 2, in which the figures shown as "Hours increase" are obtained by subtracting the time elapsing before a 200% increase in viscosity took place in the base formulation from that elapsing before a 200% increase in viscosity took place in the composition under test.

TABLE 2

| | Proportion Cu (ppm) | Phenothiazine (0.5 mass %) | Hours Increase |
|---|---|---|---|
| Comp. Ex. 4 | 0 | 0 | Base case |
| Comp. Ex. 5 | 10 | 0 | 1.0 |
| Comp. Ex. 6 | 40 | 0 | 4.9 |
| Comp. Ex. 7 | 80 | 0 | 4.9 |
| Comp. Ex. 8 | 0 | (a) | 9.9 |
| Ex. 2 | 5 | (a) | 19.4 |
| Comp. Ex. 9 | 0 | (b) | 6.0 |
| Ex. 3 | 5 | (b) | 20.9 |
| Ex. 4 | 80 | (b) | 31.0 |
| Comp. Ex. 10 | 0 | (c) | 16.6 |
| Ex. 5 | 5 | (c) | 21.1 |
| Ex. 6 | 40 | (c) | 33.5 |
| Ex. 7 | 80 | (c) | 36.1 |
| Comp. Ex. 11 | 0 | (d) | 15.6 |
| Ex. 8 | 5 | (d) | 27.3 |
| Ex. 9 | 40 | (d) | 32.2 |
| Comp. Ex. 12 | 0 | (e) | 23.4 |
| Ex. 10 | 5 | (e) | 29.3 |
| Ex. 11 | 40 | (e) | 33.3 |
| Ex. 12 | 80 | (e) | >64 |

The results show that when using both a copper compound and a phenothiazine, significantly better results are obtained than would be expected from the results for the individual components, thus indicating that there is synergism between the copper and the phenothiazine. In connection with this, although the figure for the "Hours increase" obtained when using 5 ppm copper alone is not given in Table 2, this figure would be lower than the figure of 1.0 obtained (see Comparative Example 5) when using 10 ppm copper alone.

I claim:

1. A lubricating composition comprising a major proportion of lubricating oil, 1 to 500 ppm of added copper present in oil-soluble form, and from 0.01 to 2 mass % of at least one oil-soluble phenothiazine of formula I

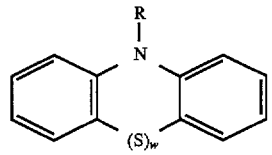

(I)

wherein each of the aromatic rings may be substituted, or unsubstituted by one or more substituents, w is an integer of from 1 to 4 and R represents a hydrogen atom or a hydrocarbyl radical having 1 to 20 carbon atoms which hydrocarbyl radical may contain one or more hetero atoms, or an oxidation product of such a compound.

2. A composition as claimed in claim 1, wherein the proportion of added copper is 3 to 250 ppm.

3. A composition as claimed in claim 2, wherein the proportion of added copper is 1 to 100 ppm.

4. A composition as claimed in claim 1, wherein, in formula (I), substituents for the aromatic rings are selected from hydrocarbyl radicals, radicals of the formula $ZR^3$ wherein Z represents 0 or S and $R^3$ represents a hydrocarbyl radical, hydroxyl radicals, halogen atoms, and fused aromatic rings.

5. A composition as claimed in claim 4, wherein, the hydrocarbyl radicals are selected from alkyl, alkenyl, aryl, alkaryl, aralkyl, alkoxy, alkylthio and arylthio radicals.

6. A composition as claimed in claim 1, wherein R represents a sulfur-containing substituent.

7. A composition as claimed in claim 6, wherein, in formula (I) R represents a hydrocarbyl radical containing at least one sulphur atom.

8. A composition as claimed in claim 1 wherein said lubricating composition is a crankcase lubricant.

9. A composition as claimed in claim 1, wherein R has the formula $—A_3—S—(CH_2CO_2)_xA_4$ wherein $A_3$ represents an alkylene, alkenylene or alkenylene radical, $A_4$ represents an alkyl, cycloalkyl, alkenyl, aryl, alkaryl, or alkaryl radical, and x is zero or 1.

10. A composition as claimed in claim 9, wherein $A_3$ represents a methylene radical, $A_4$ represents an alkyl radical, and x is zero or 1.

11. A composition as claimed in claim 10, wherein either x is zero and $A_4$ represents an alkyl radical having 6 to 15 carbon atoms, or x is 1 and $A_4$ represents an alkyl radical having 6 to 10 carbon atoms.

12. A composition as claimed in claim 1, wherein the copper is used, or incorporated in the composition, as an oil-soluble copper salt of a $C_2$ to $C_{18}$ fatty acid, an unsaturated carboxylic acid, a naphthenic acid of molecular weight of from 200 to 500, or an alkyl- or alkenyl-substituted dicarboxylic acid, an oil-soluble copper dithiocarbamate of the general formula $(R^1R^2NCSS)_nCu$ or oil-soluble copper thiophosphate of the general formula $(R^1O(R^2O)P(S)S)_nCu$, where n is 1 or 2 and each of $R^1$ and $R^2$, which may be the same or different, represents a hydrocarbyl radical containing 1 to 18 carbon atoms, or an oil-soluble copper sulphonate, phenate or acetylacetonate.

13. A composition as claimed in claim 1, further comprising one or more oil-soluble aromatic amines.

14. A composition as claimed in claim 13, wherein the proportion of aromatic amine in the composition is from 0.05 to 2 mass %.

15. A composition as claimed in claim 13, wherein the amine, or at least one of the amines, has one or more alkyl substituents on the or an aromatic rings.

16. A composition as claimed in claim 13, wherein the amine, or at least one of the amines, is a diphenylamine.

17. A composition as claimed claim 1, also comprising one or more additives selected from ZDDPs and sulphurized phenols.

18. A composition as claimed in claim 1, also comprising:

(A) a total of from 1 to 10 mass % of one or more ashless dispersant compounds;

(B) a total of from 0.3 to 10 mass % of one or more nitrogen- or ester-containing viscosity index improver dispersants, or (C) a mixture of an ashless dispersant compound and a said viscosity index improver dispersant.

19. A composition as claimed in claim 1, comprising a total of from 2 to 8000 ppm of calcium and/or magnesium as a basic calcium sulphonate and/or a basic magnesium sulfonate.

20. A composition as claimed in claim 1, also comprising one or more additional components selected from rust inhibitors, pour point depressants, antiwear agents, additional antioxidants and viscosity index improvers.

21. A composition as claimed in claim 1, wherein said oil-soluble phenothiazine is added in an amount of about 0.05 to about 1 mass %.

22. A composition as claimed in claim 1, wherein w is 1.

23. A composition as claimed in claim 19, comprising a total of from about 500 to about 5000 ppm, as a basic calcium sulphonate and/or a basic magnesium sulfonate.

24. A concentrate comprising an oil soluble composition containing:

(1) from 10 ppm to 30 mass % of copper present in oil-soluble form: and (2) from 0.1 to 30 mass % of one or more oil-soluble phenothiazines of formula (I):

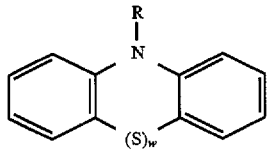

(I)

wherein each of the aromatic rings may be substituted, or unsubstituted by one or more substituents, w is an integer of from 1 to 4 and R represents a hydrogen atom or a hydrocarbyl radical having 1 to 20 carbon atoms which hydrocarbyl radical may contain one or more hetero atoms, or an oxidation product of such a compound.

25. A concentrate as claimed in claim 24, which also comprises from 0 to 60 mass % of an ashless dispersant and/or from 0 to 40 mass % of a polymeric viscosity improver dispersant.

26. A concentrate as claimed in claim 24, which further comprises a total of from 0.01 to 8 mass % of calcium and/or magnesium.

27. A concentrate as claimed in claim 24, wherein said phenothiazines are present in an amount of about 0.1 to about 20 mass %.

28. A concentrate as claimed in claim 27, wherein said phenothiazines are present in an amount of about 0.5 to about 10 mass %.

* * * * *